US006063333A

United States Patent [19]

Dennis

[11] Patent Number: 6,063,333

[45] **Date of Patent: *May 16, 2000**

[54] METHOD AND APPARATUS FOR FABRICATION OF COBALT ALLOY COMPOSITE INSERTS

[75] Inventor: Mahlon Denton Dennis, Kingwood, Tex.

[73] Assignees: Penn State Research Foundation, University Park, Pa.; Dennis Tool Company, Houston, Tex.

[ * ] Notice: This patent is subject to a terminal disclaimer.

[21] Appl. No.: 09/070,952

[22] Filed: May 1, 1998

Related U.S. Application Data

[63] Continuation-in-part of application No. 08/730,222, Oct. 15, 1996, Pat. No. 5,848,348.

[51] Int. Cl.[7] ..... B22F 7/06; B22F 7/08

[52] U.S. Cl. ..... 419/6; 419/7; 419/8; 419/9

[58] Field of Search ..... 419/5, 6, 7, 8, 419/9, 18

[56] References Cited

U.S. PATENT DOCUMENTS

| | | | |
|---|---|---|---|
| 4,501,717 | 2/1985 | Tsukamoto et al. | 419/58 |
| 4,938,673 | 7/1990 | Adrian | 419/23 |
| 5,011,515 | 4/1991 | Frushour | 51/307 |
| 5,013,694 | 5/1991 | Holcombe et al. | 501/98 |
| 5,453,225 | 9/1995 | Morrow et al. | 264/432 |
| 5,641,921 | 6/1997 | Dennis et al. | 75/230 |
| 5,848,348 | 12/1998 | Dennis | 419/5 |

*Primary Examiner*—Daniel J. Jenkins
*Attorney, Agent, or Firm*—Gunn & Associates, P.C.

[57] ABSTRACT

This disclosure features a process of making a two part drill bit insert, namely, a body portion of hard particles such as tungsten carbide particles mixed in an alloy binding the particles. The alloy preferably comprises 6% cobalt with amounts up to about 10% permitted. The body is sintered into a solid member, and also joined to a PDC crown covering the end. The crown is essentially free of cobalt. The process sinters the crown and body while preserving the body and crown cobalt differences.

29 Claims, 3 Drawing Sheets

FIG. 1
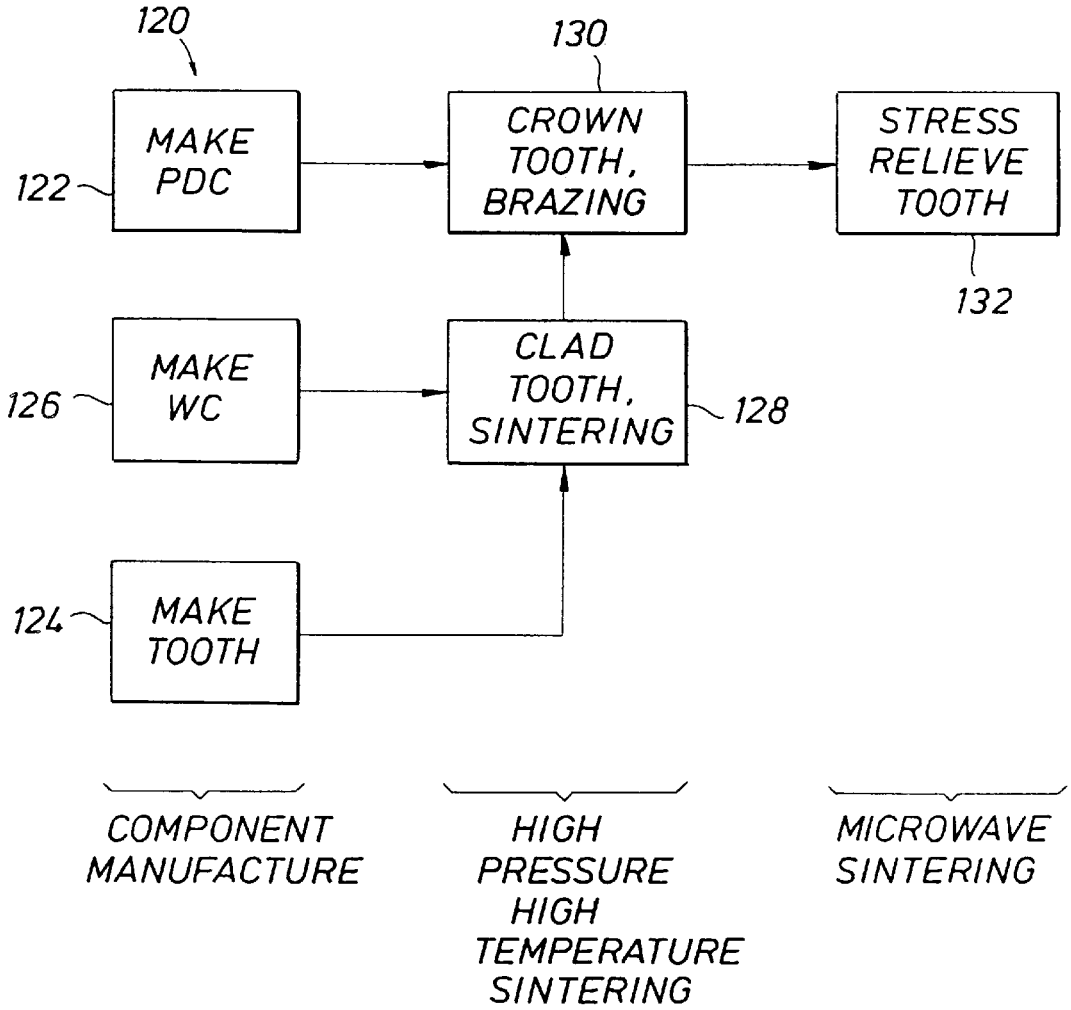
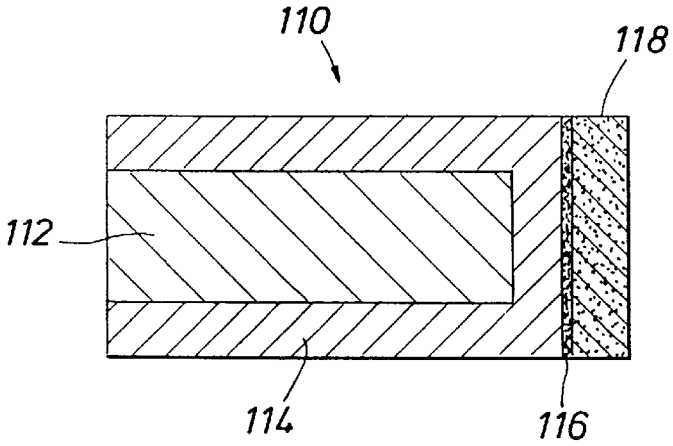
FIG. 2

METHOD AND APPARATUS FOR FABRICATION OF COBALT ALLOY COMPOSITE INSERTS

This application is a continuation-in-part of U.S. patent application Ser. No. 08/730,222 which was filed on Oct. 15, 1996, now U.S. Pat. No. 5,848,348.

FIELD OF THE INVENTION

The present disclosure is directed to the manufacture of inserts, and more particularly directed to the fabrication of wear resistant cobalt alloy inserts using various sintering techniques including microwave radiation. Inserts are typically installed in drill bits for drilling an oil well.

BACKGROUND OF THE INVENTION

An oil well is drilled with a typical tricone drill bit and assembly with threads to the bottom of a string of drill pipe. It has a hollow threaded member with an axial flow passage within the assembly to direct drilling fluid, usually known as drilling mud, out through a number of openings to wash cuttings away from the cones which form the cutting. Rotation of the drill string and attached drill bit is from the surface of the earth. Teeth on the drill bit are rotated against the face and wall of the well borehole thereby cutting the earth formations as the drill bit rotates, thereby advancing the borehole. The drill bit has three cones mounted for contact against the face of the borehole. Each cone rotates its teeth with the rotation of the drill string, thereby cutting the borehole. Drill bit wear predominately occurs at the teeth. As the teeth wear, the penetration rate declines and the drill bit has to be replaced.

Cones and their teeth have a specified wear rate. Better performance has been obtained by enhancing the wear characteristics of the cone teeth, or "inserts". Inserts are positioned within each cone hole. The inserts are harder than the metal cone. Most inserts are formed of various carbides, extremely hard materials. Primary contact and wear of the insert occurs at the exposed outer end of the insert. Greater protection yet has been provided from industrial grade diamonds. The optimum wear protection is obtained by the attachment of a cap or crown of industrial grade diamond which covers the exposed insert end. This type of crown is often known as a polycrystalline diamond compact (PDC). The carbide insert body is not pure WC, but is preferably granules of WC which are interspersed with an alloy which binds the WC particles. The preferred alloy is a cobalt based alloy. Likewise, the PDC crown is not a layer of pure diamond, but is an agglomeration of diamond particles held together with a binding metal matrix. Again, this binding material is typically a cobalt based alloy. The PDC cap or crown is normally attached to the WC insert body by ultra high pressure and heat. The sintering material may also contain a substantial amount of cobalt. Specific materials are notable. The insert body is usually WC which is harder than other common metal carbides. While other metal carbides will work in some degree, WC is the common and preferred material. In like fashion, the binding alloy is usually about 15% or so of cobalt in the alloy matrix holding the WC particles together. A common alloy with WC is sold as the model 374 by Roger's Tool Works and includes an alloy having as low as 6% up to about 15% cobalt with other metals of less significance. The cobalt is the most significant part of the alloy as will be discussed below.

In prior art, elements of the insert are typically manufactured separately and subsequently assembled. The manufacture of the components is usually by sintering under very high temperature and very high pressure. This requires equipment which is physically large, and which is also very expensive to manufacture, maintain and operate. In addition, the high temperature can induce adverse chemical and physical changes in insert components, which will be discussed in subsequent sections of this disclosure.

As discussed in U.S. Pat. No. 5,011,515, composite polycrystalline diamond compacts, PDC, have been used for industrial applications including rock drilling and metal machining for many years. As an example, the composite compact consisting of PDC and sintered substrate are affixed as insert elements in a rock drill bit structure. One of the factors limiting the success of PDC is the strength of the bond between the polycrystalline diamond layer and a sintered metal carbide substrate. It is taught that both the PDC and the supporting sintered metal support substrate must be exposed to high pressure and high temperature, for a relatively long period of time, in order to achieve the desired hardness of the PDC surface and the desired strength in the bond between the PDC and the support substrate.

U.S. Pat. No. 3,745,623 (reissue U.S. Pat. No. 32,380) teaches the attachment of diamond to tungsten carbide (WC) support material with an abrupt transition there between. This, however, results in a cutting tool with a relatively low impact resistance. Due to the differences in the thermal expansion of diamond in the PDC layer and the binder metal alloy used to cement the metal carbide substrate, there exists a shear stress in excess of 200,000 psi between these two layers. The force exerted by this stress must be overcome by the extremely thin layer of cobalt which is the common or preferred binding medium that holds the PDC layer to the metal carbide substrate. Because of the very high stress between the two layers which have a flat and relatively narrow transition zone, it is relatively easy for the compact to delaminate in this area upon impact. Additionally, it has been known that delamination can also occur on heating or other disturbances in addition to impact. In fact, parts have delaminated without any known provocation, most probably as a result of a defect within the interface or body of the PDC which initiates a crack and results in catastrophic failure. See also Patent 4,811,801.

One solution to the PDC-substrate binding problem is proposed in the teaching of U.S. Pat. No. 4,604,106. This patent utilizes one or more transitional layers incorporating powdered mixtures with various percentages of diamond, tungsten carbide, and cobalt to distribute the stress caused by the difference in thermal expansion over a larger area. A problem with this solution is that "sweep-through" of the metallic catalyst sintering agent is impeded by the free cobalt and the cobalt cemented carbide in the mixture. In addition, as in previous referenced methods and apparatus, high temperatures and high pressures are required for a relatively long time period in order to obtain the assembly disclosed in U.S. Pat. No, 4,604,106. Pressures and temperatures are such that, using mixtures specified, the adjacent diamond crystals are bonded together.

U.S. Pat. No. 4,784,023 teaches the grooving of polycrystalline diamond substrates but it does not teach the use of patterned substrates designed to uniformly reduce the stress between the polycrystalline diamond layer and the substrate support layer. In fact, this patent specifically mentions the use of undercut (or dovetail) portions of substrate ridges, which solution actually contributes to increased localized stress. Instead of reducing the stress between the polycrystalline diamond layer and the metallic substrate, this actually makes the situation much worse. This is because the larger volume of metal at the top of the ridge will expand and contract during temperature cycles to a greater extent than the polycrystalline diamond, causing the composite to fracture at the interface. As a result, construction of a polycrystalline diamond cutter following the teachings provided by U.S. Pat. No. 4,784,023 is not suitable for cutting applications where repeated high impact forces are encountered, such as in percussive drilling, nor in applications where extreme thermal shock is a consideration.

By design, all of the cutting surfaces consisting of "conventional" alloys which are disclosed in the above references are "hard" in that they are abrasion and erosion resistant. This is particularly true for PDC material which is also quite brittle and subject to fracturing upon impact. Because of the brittleness and overall hardness, it is not practical and economical to machine surfaces of tools, bearings and the like made of PDC in the manufacturing process for these devices. Alternately, the PDC surfaces are preferably "molded" or performed using techniques taught in U.S. Pat. No. 4,662,896. Brittleness and fracture resistance are also noted in Patent 4,811,801.

The paper "Iron Aluminum-Titanium Carbide Composites by Pressureless Melt Infiltration-Microstructure and Mechanical Properties" by R. Subramanian et al (*Scripta Materialia*, Vol. 35, No. 5, pp. 583–588, 1996, Elsevier Science Ltd.) discloses a technique for fabricating wear resistant material which does not require high pressure. Conversely, a mixture of powdered components is placed in a dynamic vacuum of 10–4 Pa, heated to a temperature of 1450 for about one hour. The binding component melts and flows into the interstitial voids of the wear resistant component. Vacuum equipment is obviously required to fabricate the wear resistant material.

U.S. patent application Ser. No. 08/517,814 which was filed on Aug. 22, 1995 by the present inventor discloses apparatus and methods for forming composite inserts at relatively low temperature and pressure. The composite insert can be assembled by brazing a separately sintered wear component to a support component, or by sintering the wear component directly onto the support component. The wear surface consists of a sintered mixture or "cermet" of crystalline material, metal and/or metallic carbides. These alloy materials are selected to minimize the sintering heat and temperature requirements. In a preferred embodiment, the wear surface material created by sintering consists of a mixture of abrasion resistant crystals, preferably diamond crystals, and a metal, which partially transforms during sintering to metal carbide, is a cemented diamond compact containing 60% or more diamond by volume, but lacking diamond to diamond bonding. Due to the high metal content and the short time of sintering, not all of the metal is reacted with the abrasion resistant material. The metal which is not reacted is then free to form a matrix in which the abrasion resistant material is suspended. This metal matrix is responsible for the enhanced ductility and fracture toughness of the material. The end result is a material with comparable abrasion and erosion properties to conventional, prior art materials, but the cermet is less costly to produce, has better impact resistance, and is more easily formed. A mold or cast is required to contain the wear resistant component in the low temperature cermet alloy during the low temperature and low pressure sintering operation. Disclosed means for heating are a simple torch, an induction oven, a source of infrared light, a laser source, a plasma, or a resistive heating oven. Attempts are made to use materials with matching thermal coefficients to minimize stress between the cermet and support components and stress within the cermet, although it is still sometime preferable to anneal the final product to reduce stress in the finished product.

The parent application for this continuation-in-part discloses apparatus and methods for forming sintered components of alloys using microwave energy as a heat source, wherein the alloys are "conventional" in that they were previously used only in high temperature and high pressure sintering processes The insert body and the insert wear crown can be sintered as an integral insert within a mold, or can be sintered separately and subsequently joined by brazing as previously discussed. As an important additional advantage, the mold to contain the raw materials can even be completely eliminated by the use of a sacrificial binding agent such as wax prior to sintering. The microwave energy source permits the sintering process to be completed in a relatively short period of time, and at very low pressure. Temperature can also be controlled. If sintered as a unit, migration of cobalt within the various components is negligible due to the relatively short sintering time required. The disclosure also teaches that smaller grain sizes can be obtained without the use of grain growth inhibitor, which can adversely affect the insert in other ways. Stress concentration at the interface of insert components is still present, although markedly reduced if the insert is sintered as a unit. Stress concentration at the interface of components assembled after sintering can be significant.

There is a delicate balance to be obtained in the finished wear product between hardness and resiliency. If materials are harder, they are lacking in resilience, and if they are resilient, they are lacking in hardness. As discussed previously, composite materials such as a wear resistant crown and an insert body of differing material yield high quality inserts. However, the composite materials are all different and therefore have contradictory criteria meaning they have different measures of hardness, different resiliency, different rates of thermal expansion, and different measures of shock resistance. A representative insert will be described which utilizes a central steel shank or body. The body, in turn, is covered with the WC abrasive resistant material. Separalely, a PDC crown is made at another location and then this PDC layer is brazed to the partly finished WC clad steel shank. Prior art manufacturing is typically by high pressure high and temperature sintering, sometimes known as "HPHT" sintering. While the finished product is quite successful, there are, however, problems that arise because of the dissimilarities in the various materials making up the finished device. In one aspect, the sintering process mandates that the components be made separately and later joined. This leads inevitably to transverse planar regions which localize possible stress failure. In a typical insert, the PDC crown is brazed by a braze region which measures only about 0.001 to about 0.004 inches thick. Moreover, this thin region of braze material must secure dissimilar materials together so that there are stress levels in this braze region which are detrimental to long life. Even if the stress is relatively minimal by careful manufacture, the drill bit is used in elevated temperatures so that stress concentrations can again build up which are not common at ambient temperatures. Regrettably, the failure mode of many inserts is fracture along the braze plane so that part or all of the PDC crown will break off.

This type of insert defies stress relieving by annealing using some prior art teachings. For instance, in the manufacture of glass and other relatively brittle materials, the finished product can be gently heated to a relatively high temperature for a long period of time and then gently cooled over a long time interval to obtain some internal stress relief.

That is not so readily effective for composite drill bit inserts. There is a problem with migration of cobalt between differing elements or regions of the composite insert. Suffice it to say, the cobalt levels in different regions vary because different quantities of cobalt are required to provide the bonding matrix holding the various different particles together. The cobalt concentration in the PDC layer is different from the cobalt corncentration in the braze layer, and is different from that in the WC sheath. Heating for a long interval at elevated temperature may enable the cobalt concentration to simply average out, thereby degrading the performance of the cobalt based alloy in one region or the other.

The heating phase of both sintering manufacturing methods and post manufacture annealing methods can also be detrimental to the different regions of the insert. As an example, the crystalline structure of carbon on the PDC can be adversely affected by physical changes at high temperatures, whether applied in the manufacturing step or the annealing step. This reduces the wear properties of the PDC. Above a certain temperature, the carbon will begin to oxidize or otherwise be affected chemically, thereby also significantly reducing the wear properties of the PDC. Therefore, it is necessary to maintain sintering and annealing temperatures below a threshold at which damage to the PDC is incurred. Using prior art teaching, this can be accomplished by longer wintering and annealing heating times but at lower temperatures. These longer heating periods, however, result the previously discussed cobalt migration problem which, contradictorily, is minimized by heating for a shorter period of time but at a higher temperature.

Sintering and annealing at elevated temperatures for long periods of time can be detrimental to the grain size of the wear surface which can, in turn, affect the resilience of the wear surface. The smaller the grain size, the more resistant the material is to chipping and fracturing. High sintering and annealing temperatures tend to increase the grain size of sintered material and thereby degrade wear properties.

The use of a mold to fabricate wear inserts or integral wear resistant parts can be very expensive, especially if relatively small numbers of pieces are to be fabricated. An expensive mold or cast is required in the sintering of conventional alloys using high temperature-high pressure techniques while a low cost mold is need in microwave sintering of conventional alloys using methods and apparatus disclosed in the parent U.S. Patent Application.

In summary, prior art teaches the manufacture and the use of various abrasion and erosion resistant materials to form inserts which are used as wear surfaces in drill bits, and which can also be used for wear surfaces on machine tools, drill bits, bearings, and other similar surfaces. Many of the processes in the cited references require high temperatures and high pressures to sinter conventional alloys for a relatively long period of time to form the wear resistant surface material, or to bond the wear resistant surface material to the underlying support substrate, or both. A mold or cast is required. Using a composite drill bit insert as an example, cobalt can migrate between wear surface, braze layer, and insert body thereby perturbing the desired concentration of cobalt in each element of the insert. Furthermore, the bond between surface and substrate of the resulting inserts is subject to weakening due to differences in thermal expansion properties which become a factor as the device heits up during use. This can be reduced by annealing, but annealing at high temperatures over long periods of time also results in cobalt migration as discussed in the example above. Sintering and annealing heating for extended periods of time can also cause grain size growth which yields a wear surface which is quite brittle, subject to fracturing upon impact, and are in general very difficult to handle in the manufacturing process of tools employing such wear resistant surfaces. Sintering and annealing at high temperature can also adversely affect the chemical and physical properties of the wear surface. As an example, a PDC wear surface will tend to oxidize if heated at elevated temperatures. To minimize elemental migration between regions, to minimize grain growth, and to minimize damage to the wear surface, it is desirable to apply sintering and annealing heat it a relatively low temperature and for a relatively short period of time. Low pressure is also desirable from an economic and operational point of view. Low pressure and low temperature sintering of wear resistant components enable a low temperature allow and a mold or cast to be used. The fabrication of wear elements by means of low temperature-low pressure sintering of conventional and low temperature alloys, using microwave energy, without the use of a mold, are not known in the prior art.

The present invention sets out an improved alloy system with different levels of key ingredients in different regions. When bonded by heat, alloy migration in the regions is prevented, and regional differences are preserved. This enables simultaneous bonding of a PDC layer with a higher level of cobalt, an amount usually around 15% cobalt.

The WC body of the insert is alloyed with cobalt; but contrary to prior WC alloy bonding, the cobalt is not 15% or so. Rather it is in the range of about 6 to 10% cobalt. The optimum for many WC insert bodies is around 8% cobalt. The process begins with the PDC and WC ingredients in a mold compressed by packing with light pressure. The loose molded ingredients are held in the mold with minimal pressure prior to heating.

Microwave heating is preferred because it is quicker, operates at a lower temperature, and needs only minimal or no pressure, and can be done in a low pressure mold.

One object of the invention is to provide apparatus and methods for manufacturing sintered, composite wear inserts, wherein the sintering temperature is generated by microwave energy and is below a level which inflicts adverse physical and chemical changes in components of the composite insert.

Yet another object of the invention is to provide apparatus and methods for manufacturing sintered, composite wear inserts, wherein the heating cycle is relatively short in duration thereby preventing elemental migration between various components of the composite insert.

Still another object of the invention is to provide apparatus and methods for manufacturing sintered, composite wear surfaces, wherein the magnitude and duration of the heating phase of the sintering operation is set to minimize grain size growth in components of the composite insert.

An additional object of the invention is to provide apparatus and methods for effectively sintering low cobalt insert bodies. One benefit of the approach is reducing stress concentration at component interfaces, minimizing the migration of constituents between the components, and inhibiting grain growth within the components.

A still further object of the invention is to provide apparatus and methods for fabricating wear elements without the use of a high pressure cast or mold.

SUMMARY OF THE INVENTION

The present disclosure is summarized as a method for sintering composite wear inserts using microwave radiation as a heat source. Low cobalt or low temperature alloys can be used in the wear inserts, and a simple mold or cast is used for the fabrication process.

INTERACTION OF MICROWAVE RADIATION AND METAL

As a precursor to summarizing the invention, the basic principles of interaction of microwave radiation with metal will be reviewed. The modes of interaction between material and electromagnetic radiation in the microwave region can be defined as transparent, absorbent and reflective. The interaction is defined as transparent when the microwave radiation passes through the material with little attenuation. The interaction is described as absorbent when the microwave radiation is completely absorbed within the material. The interaction is described as reflective when the microwave radiation is reflected away from the material without attenuation.

The modes of interaction between microwave radiation and material are affected by the frequency of the radiation and the temperature of the material. Assume first that for a given material temperature, the mode of interaction is reflective. As the frequency of the radiation is changed to some threshold level, some of the microwave radiation will be absorbed by the material. As the frequency is further altered, more radiation will be absorbed. Eventually a frequency will be reached at which all radiation will be absorbed. If the frequency is still further changed, absorption will decrease and transparency will become a mode of interaction. When the frequency is changed beyond a second threshold level, the material will become completely transparent.

Assume again that for a given material, the mode of interaction is reflective. Further assume that the frequency of the microwave radiation is held constant. As the material is heated (presumably from an external source) above a threshold temperature level, the dielectric loss begins to increase rapidly and the material begins to absorb microwave radiation and reflect less. The absorption also generates heat to rapidly increase the temperature of the material internally and independent of any external heat source. As the temperature of the material is increased further, absorption dominates the interaction mode and as the temperature is increased even further (presumably by means of an external heat source), absorption declines and reflection dominates.

In the remaining portions of this disclosure, it will be assumed that all microwave sintering and stress relieving processes begin a L an ambient "room temperature".

MANUFACTURE OF WEAR RESISTANT PARTS

Turning first to the manufacture embodiment of the invention, microwave heating has demonstrated itself to be a powerful technique for sintering various ceramics, especially through the past decade. Microwave heating may decrease the sintering temperatures and times dramatically, and is economically advantageous due to considerable energy savings. However, one of the major limitations is the volume and/or size of the ceramic products that can be microwave sintered because of non homogeneous microwave energy distribution inside the applicator which often results in a non-uniform heating.

This disclosure features two of three different types of products of manufacture which can be handled by microwave heating to obtain sintering. The three different types of products refers to the form of the products, not the chemical makeup of the products. Indeed, the products can be made of the same constituent ingredients. They differ however primarily in the shape and hence the cohesive nature of the respective products. These three product formats or forms include loose particulate material such as (1) a powder of a specified size, (2) a molded product, or (3) a precast molded product. The distinction in the latter is that it is precast sufficiently that it requires no mold during sintering. It can be precast with a sacrificial wax, adhesive, moisture are even low pressure compaction of the material which forms the particles together into a desired precast form. During sintering, the form is not changed in terms of shape, but the form is sustained although this is accomplished free or devoid of a confining mold. The molded product is a product which is held in a mold during sintering. One of the advantageous aspects of the molded products is that initial mold shaping of the particles making up the product can be accomplished at very low temperatures and pressures, i.e., substantially at room temperature and atmospheric pressure. Typically, loose particles are joined in a mold again by a sacrificial wax, other material, low pressure compaction or alternately by the confines of the cavity mold itself. In either instance, the finished product is a structure which is sintered and yet which has a defined shape or profiles. Examples abound as will be set forth below.

In all instances, all examples will be described so that the sintering process begins or acts on what are known as "green" materials. The term "green" materials refers to those materials which have been provided but have not been sintered. These green materials are the low temperature-low pressure alloys disclosed in the parent U.S. Patent Application. In addition, the green materials can consist of conventional ingredients used in prior art high pressure-high temperature sintering techniques taught in the prior art. For particulate matter, the green materials typically have the form of powders. Both in the molded and precast forms one of the beginning materials is the requisite quantity of particles prior to molding, i.e., shaping into a desired form either by precast molding or sintering in a mold.

The preparation of loose material to be sintered defines small particles which can be used later in a wear surface and the like. Normally, these materials must be sintered to a specified grain size. In many applications, the quality or performance of the material is directly impacted by the grain size accomplished in the sintering process. In one aspect, grain size has an undesirable impact on the finished product. More specifically, this arises from the fact that additives often are placed in controlled quantities in the material prior to sintering so that the grain boundaries are defined by the additives. While there are additives available which do control grain size, the additives weaken o: reduce the hardness of the finished product. Therefore such additives, while desirable in one aspect, are not desirable in other regards. The amount, nature, and dispersal of such grain boundary additives is a material factor, thereby providing a balanced mix of properties where the properties themselves result in some kind of compromise in the design of such sintered products. Effectively, grain boundary size is controlled only at a cost in sintered particle hardness.

Continuous microwave sintering is designed to focus the microwave radiation field in a central area as uniformly as possible. A long cylindrical ceramic hollow tube contains the unsintered (or green) material which is fed into the microwave applicator and into the central area at a constant feed speed. As the green material enters the microwave cavity, it is heated and gradually sintered while passing through the microwave zone. The heating rate, sintering time and cooling rate are controlled by the input microwave power, the feeding speed, and the thermal insulation surrounding the heated material. The ceramic hollow tube can also be rotated during processing for more uniform and homogeneous heating. As the green material passes through the high temperature zone, the particles are sintered entirely. Since the ceramic hollow tube is moved continuously in the axial direction during the processing, there is virtually no limitation to the length or volume of the product that can be processed by this technique. Consequently, it is possible to scale up the volume of the ceramic products to be microwave sintered by this technique by implementing a continuous process.

This disclosure proves the continuous microwave sintering for drill bit inserts. The results show better physical properties than the conventionally processed material. The disclosure sets out two different product configurations. One form is a cold press shaped or configured particulate body shaped by a mold at minimal pressure, and a third form is a cold pressed, unconfined form of sufficient strength to hold its own shape either with or without a sacrificial binding agent such as wax. The products are generally referred to below as molded products and precast products.

In prior art devices, molds are typically used for sintered particles or for composite cast items (molded or precast) such as wear inserts for drill bits. A molded part can be sintered by placing green particulate materials in a mold or cavity in the desired geometric configuration. The mold is first filled with the appropriate, configured green constituent materials. As an example, tungsten carbide or silicon nitride particles arc packed into a mold or cavity. An interspersed particulate binder metal typically a cobalt alloy, is added in the mold or cavity. In the prior art, extreme heat with deleterious consequences was applied in the ordinary manufacturing process along with extremely high pressure to form a molded part. The resultant part is a matrix of hard particles which are held together by the melted alloy. The alloy serves as a binder which holds the shape of the finished part. By applying an adequate high pressure to the cavity and by also applying an adequate high temperature for an adequate interval, molded parts were made in this fashion. The prior art high pressure and high temperature (HPHT) equipment is quite large, quite expensive to fabricate, and quite expensive to operate. Furthermore, high temperature and/or extended heating periods can be detrimental to the final product as discussed previously.

The microwave process of this disclosure does not require massive and expensive manufacturing equipment, thereby reducing cost and improving speed of fabrication. By contrast, such molded products can be made using the microwave sintering apparatus and method set forth in the present disclosure. The particulate materials are tamped into a cavity at a desired packing density and configuration without requiring any extremely high pressures. The cavity is formed in a tube of material which is transparent to microwave radiation. This transparent tube is then positioned in the microwave cavity of the sintering apparatus. Sintering occurs at a more rapid temperature increase, yet is consummated at a lower maximum temperature level. The former feature minimizes migration of elements such as cobalt between regions or components of the article of manufacture. The latter feature reduces the possibility of high temperature induced physical or chemical damage to components of the device. Moreover, the grain size within the solid part of the device does not grow as normally occurs in a conventional sintering process. Improved hardness and chip resistance is obtained with a smaller grain structure in the molded part. The alloy sinters the entire particulate mass in the mold to thereby furnish a wear part. Examples of this will be given below.

The particulate or green material is shaped at room or ambient temperature in a mold, a preliminary process called "cold pressing". The tamped or pressed particles are shaped to the desired configuration by a low cost cavity or mold. The mold need not be a high pressure mold. If the particles are sufficiently self adhesive, the particles can be precast by low pressure compaction into the desired shape and then sintered. If crumbling of the precast occurs, a sacrificial adhesive material such as wax can be mixed with the particles prior to precasting. During sintering, this sacrificial material is driven by heat from the precast. As are alternate to precasting, the green material can be formed in the low cost, microwave transparent mold can be exposed to the microwave field to sinter the mold contents.

By the use of the manufacture process of the present invention, it is possible to prepare new drill bit inserts at considerably lower temperature with smaller grain size, higher hardness and density. The process of the present invention also uses microwave sintering to obtain higher heating rates to form better PDC clad inserts. It has been found that for the microwave frequency range used and at room temperature, green materials used in the manufacture of wear inserts and the like are primarily reflective but still somewhat absorptive of microwave radiation. When exposed to microwave radiation, this partial absorption results in an initial heating of the material which, in turn, increases the dielectric constant of the material which, in turn, further increases the absorptiveness of the material which, in turn, results in further heating of the material. This "bootstrap" heating process terminates when the temperature of the material is elevated to a value at which the material becomes completely absorptive. This concept will be discussed further, and is a major contributor to the higher heating rate of the microwave sintering process. Heating rates as high as 300° C./minute can be obtained. Furthermore, the desired sintering can be obtained at temperatures below which components are adversely physically and chemically altered. In the process of the invention, microwave heat is generated internally within the material instead of originating from external heating sources, and is a function of the material being processed.

As a rule of thumb, the performance of the particulates with the same hardness, toughness and density improves with decrease in grain size. It is possible to achieve very small grain sizes with high hardness, toughness and density, using the microwave processes thereby improving the characteristics when compared to the conventional process. This process requires much lower temperature (less than about 1350° C.) than conventional sintering techniques (around 1500° C.).

Using the apparatus described, the composite insert is placed within the microwave cavity and exposed to microwave radiation at preferably a set frequency. At this frequency and at room temperature, it has been found that the components of the insert are reflective to the microwave radiation. This is in contrast to green materials which have been found to be at least partially absorptive of the microwave radiation at room temperature. Heat from an external source is therefore optionally applied to the insert until the temperature of the insert is increased above the threshold of partial absorption or, microwave heating will suffice. At this temperature, the previously described bootstrap heating of the insert is initiated. That is, the dielectric constant of the insert begins to increase rapidly, resulting in a rapid increase in absorption of microwave energy, which in turn results in the rapid heating of the composite insert. The desired sintering temperature is rapidly reached once the insert becomes absorptive. Using this methodology, heating rates as high as 300° Centigrade (C) per minute are obtained, thereby allowing a desired annealing temperature of perhaps 1200° C. to be reached in only four minutes, at which time cooling can begin. Migration of alloy metal such as cobalt is negligible during these time intervals as will be discussed subsequently. Furthermore, grain size growth is held to a minimum. Finally, exposing the insert to the maximum sintering or annealing temperature for such a short period of time cause no damage, such as oxidation, to the PDC crown.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a block diagram flow chart showing a method of manufacture which involves microwave annealing to thereby permit the stress relief of a multicomponent or composite insert;

FIG. 2 is a sectional view through a typical insert showing different regions of material in a composite insert

DETAILED DESCRIPTION OF A PREFERRED EMBODIMENTS

Figure 3:
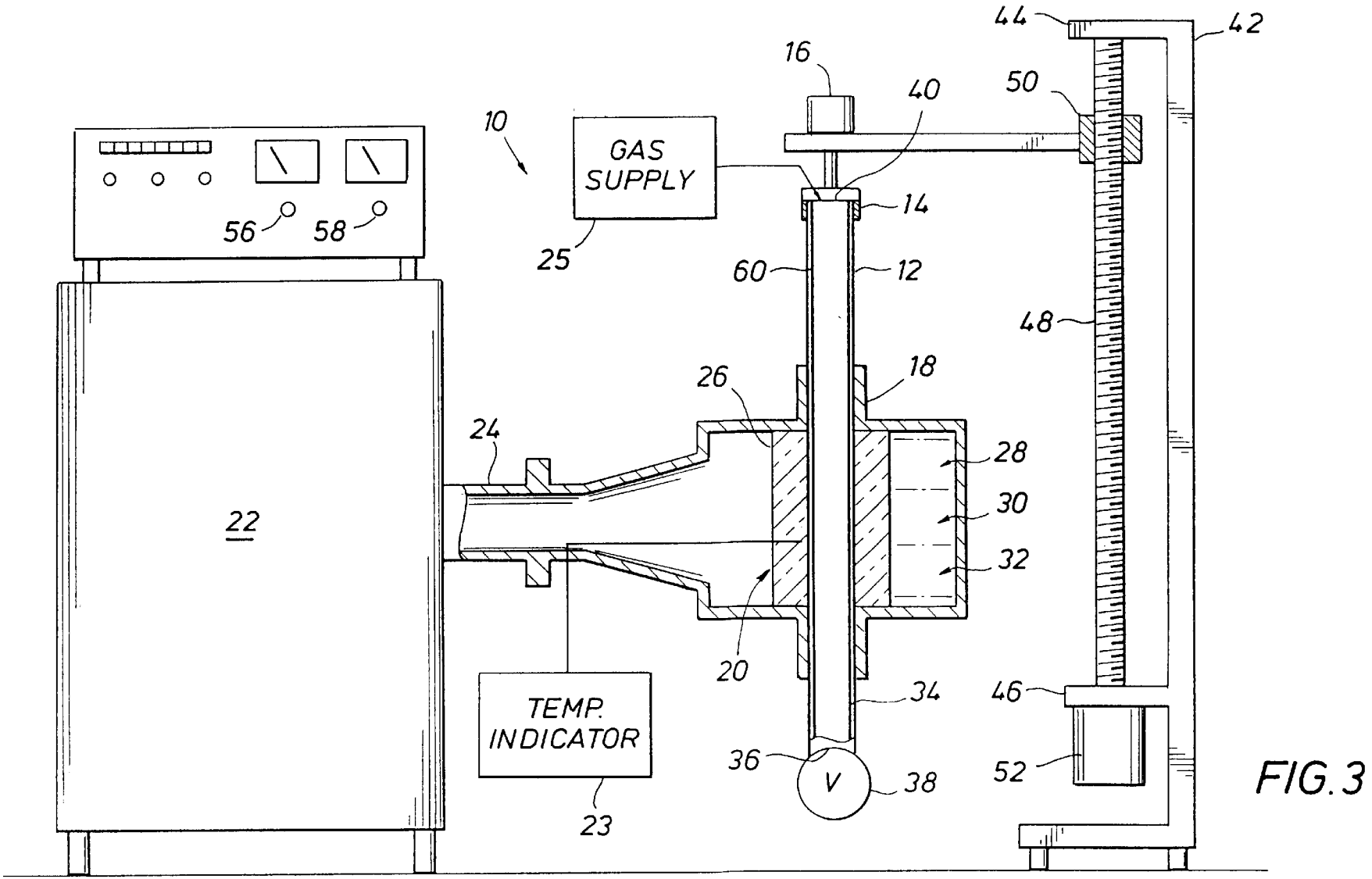
FIG. 3 is a system drawing of a microwave oven arrangement for reduced temperature sintering.

FIG. 1 of the drawings shows as a simplified operational diagram consisting of both manufacturing steps in making an insert and a post-manufacture annealing step For purposes of discussion, it will be assumed that the manufactured wear insert consists of three components which are a steel shank or "tooth", a tungsten carbide (WC) sheath about the tooth, and a PDC wear resistant crown affixed to the WC sheath. The tooth is fabricated at operation 124. The WC is prepared and possibly sintered to the desired grain size at step 126. The WC is then applied to the exterior of the tooth at step 128. A PDC crown is made at step 122 which possibly includes sintering to the desired grain size. The PDC crown is then affixed, preferably by brazing, to the WC clad tooth at step 130. This results in a manufactured wear insert. It should be mentioned that the insert can be made in a variety of ways including the HPHT methodology of the prior art or the composite microwave sintering methodology taught in the present disclosure. Post-manufacture annealing is accomplished at step 132.

Attention is now directed to FIG. 2 which shows a cross sectional view of the manufactured wear insert tooth identified as a whole by the numeral 110. The WC layer 114 is applied to the exterior of the preferably steel insert or "tooth" body 112 to provide a surface covering over the entire surface of this steel member. The WC protective layer 114 is formed of two major components comprising powdered WC and a binder. WC particles are held together in the binding matrix. The WC particles, which are extremely hard, are mixed with an adhesive and an adherent alloy which is melted thereby forming a binding material. The irregularly shaped WC particles are held together with the alloy matrix so that the particles are packed around the steel shank 112 and adhere to it. In this regard, the alloy is a binding agent so that the particles are held together and are held to the insert body 112. The insert body 112 may be steel powder partially compacted to various densities to alter residual stresses in the finished parts. In some cases, stress will be small or non existent, either totally or regionally in the fabricated part. FIG. 2 shows a braze layer 116 which is used to attach the PDC crown 118 to the wear primary WC surface.

Still referring to FIG. 2, all three regions of materials 114, 116 and 118 incorporate cobalt or alloy of cobalt at different concentrations. As a practical matter, the PDC and WC layers include hard particles which make up the bulk of those two portions. In other words, the alloy may constitute only about 5% to about 20% of those two regions. The braze alloy, however, makes up 100% of the braze layer 116. In these three regions, the amount of cobalt in the supportive metal alloy matrix is different, and because it is different, such differences impose a process limitation as will be explained on annealing.

It should be understood that there is flexibility in the methods used to fabricate composite wear resistant elements. As an example, the protective layer 114 can be fabricated using a variety of techniques such as conventional HPHT techniques, or low pressure and low temperature techniques as disclosed in previously referenced parent application. The layer 118 is fabricated by means of microwave sintering and preferably brazed using microwave radiation as a heat source. The material used for the protective layer 114 can be either conventional alloy or low temperature and low pressure sintering alloy as discloses in parent application. "Conventional" alloys, as referred to throughout this disclosure, usually contain hard, abrasive resistant crystals and a relatively high concentration of cobalt as will be discussed below. "Low temperature" alloys, as referred to throughout this disclosure and as disclosed in parent application include abrasion resistant particles, bonding material which wets and reacts with the abrasion resistant particles, and a contiguous, solid matrix material in which the reacted particles of abrasion resistant materials are suspended and bonded. The contiguous matrix material preferably consists essentially of a metal such as titanium or zirconium carbide, boride, or nitride. The bonding material preferably consists essentially of metallic carbide, boride, or nitride, or alternately, consists essentially of titanium or zirconium carbide, boride, or nitride. The matrix material preferably consists of titanium or zirconium or alloys thereof.

MANUFACTURE OF WEAR INSERTS

Going over the apparatus in FIG. 3 in some detail, a microwave system 10 incorporates a microwave generator 22 which forms the microwave radiation at some extremely high frequency which is conveyed by a wave guide 24 to the microwave cavity. The cavity is defined on the interior of an insulative sleeve 26. The microwave cavity communicates to the central area 20. In the central area 20, the material is heated in a first zone 28 and reaches the maximum or sintering temperature in an intermediate zone 30. Zone 30 is contiguous with the zone 28. Recall that it has been found that for the microwave frequency used and at room temperature, the green material is somewhat absorptive when it enters the microwave radiation, and becomes more absorptive and therefore hotter until it reaches the sintering temperature in the zone 30.

FIG. 3 is configured to sinter a continuous supply of green material product (not shown). Configuration of the device to sinter composite parts will be discussed in detail in a subsequent section. The sleeve 26 prevents heat loss through the tube 12 as will be explained. As the product moves downwardly, it enters into the zone 32 where cooling begins. There is a discharge zone 34 at the lower end. The sintered material is delivered through the lower end 36. For the sake of controlling the flow rate, a valve 38 is affixed at the lower end to meter the delivered product. At the upper end, the tube is open at the top end 40 and the green ingredients are introduced through the upper end. The collar or clamp 14 fastens on the exterior and preferably leaves the top end 40 open for material to be added. The clamp 14 holds the tube 12 for rotation when driven by the motor 16. An adjacent upstanding frame 42 supports a protruding bracket 44 aligned with a bottom bracket 46. The brackets 44 and 46 hold a rotating screw 48 which serves as a feed screw. A movable carriage 50 travels up and down as driven by the screw. The screw 48 is rotated by the feed motor 52 shown at the lower end of the equipment. Rotation in one direction or the other causes the carriage 50 to move up or down as the case may be.

The microwave system shown in FIG. 3 is provided with an adjustable power control 56 and a timer 58. The timer is used in batch fabrication while the system 10 is normally simply switched on for continuous sintering. Attention is momentarily diverted to one aspect of the tube 12. It preferably is a dual tube construction with a tube 60 fitting snugly inside the outer tube 12. This defines an internal cavity through which the green insert is added at the top 40. It flows along the tube at a rate determined by the rate at which the valve 38 is operated so that the material is maintained in the hottest zone 30 for a controlled interval. For instance, the rate of flow down through the tube can be increased or decreased by throttling the flow through the valve 38. This assures that the material remains in the hottest portion 30 of the microwave cavity. By rotating the tube continuously within the central area 20 of the microwave cavity and continuing a feed through the tube 12 which causes gradual downward linear motion, the inserts are processed as appropriate by microwave sintering. By rotating without feeding the tube 12 through the cavity, but with controlled inserts flow through the tube 12 and valve 38, continuous sintering of a controlled flow can be (lone.

The microwave generator 22 employed produces microwave energy of preferably 2.45 GHz frequency but can be effectively operated in the range of 0.5 GHz to 4 GHz. Power delivered to the microwave cavity is normally within the range of 10 to 50 Watts per cubic inch of heated space, with a preferred power output of 30 Watts per cubic inch of heated space. In an alternate embodiment (not shown), the generator contains an additional frequency adjustment whereby the output frequency can be adjusted thereby controlling when the material within the microwave cavity becomes reflective, absorbent, and transparent. The insert material is placed in the closed insulating microwave cavity. The insulating material is an aluminum oxide based material. An inner sleeve 60 of porous zirconia can also be included. The system reduces heat loss from the cavity while maintaining high temperatures. A sheathed thermocouple, denoted conceptually by the element 23, is introduced for temperature measurement, and placed in the zone 30. This microwave system as configured in FIG. 3 provides batch or continuous processing of green material such as alumina abrasive grains. FIG. 3 shows a gas supply which can optionally flood the regions of heated material and force oxygen out. Stated another way, the material is exposed to microwave radiation in a controlled atmosphere. This may reduce the risk of oxidation of sintered material.

As mentioned previously, the device shown in FIG. 3 is configured for sintering loose green particulate material and is used to illustrate basic concepts of the invention, and should not be construed to limit the scope of this present invention. Several examples relate to processing loose particles, cold pressed particles in a mold, and cold pressed particles holding a shape without regard to shape and free of a mold.

The quality of the microwave sintered particles mainly depends on the sintering temperature and time. During the continuous microwave sintering processing, the temperature is controlled by microwave power, and the sintering time, which is actually the residence time of the samples in the high temperature zone. The uniform high temperature zone is about 80 mm long in the microwave applicator. In this case, the residence time of the sample in the high temperature zone was about 15 minutes at a feeding speed of 2 mm/min.

MOLDED PART MANUFACTURE

The apparatus shown in FIG. 3 has been described above as processing green material which is input to the hollow tube thereby enabling the manufacture of sintered particles. In many instances, that satisfies the requirements of the sintering procedure. In this aspect, the sintering equipment is used to manufacture a molded or cast member. This is a product which has been made heretofore in the prior art typically by high pressure, high temperature (HPHT) fabrication in a mold installed in a high pressure press. This uses two mold parts (male and female) which are brought together to define a mold cavity. The cavity is packed with particulate material including desired portions of selected carbides, nitrides or other hard particles and they are heated in the presence of a metal alloy which melts, thereby forming the requisite shaped or finished wear part. In the past, the mold had to be a heavy duty mold filled with the particulate green material and installed in a hydraulic press which applies very high pressures. Using the novel approach of the present invention, such pressures are not required and therefore the expensive hydraulic press and mold are not needed. Accordingly, part of the present disclosure sets forth a method of manufacturing what might be termed cast or molded composite wear parts using a microwave sintering technique.

Figure 4:
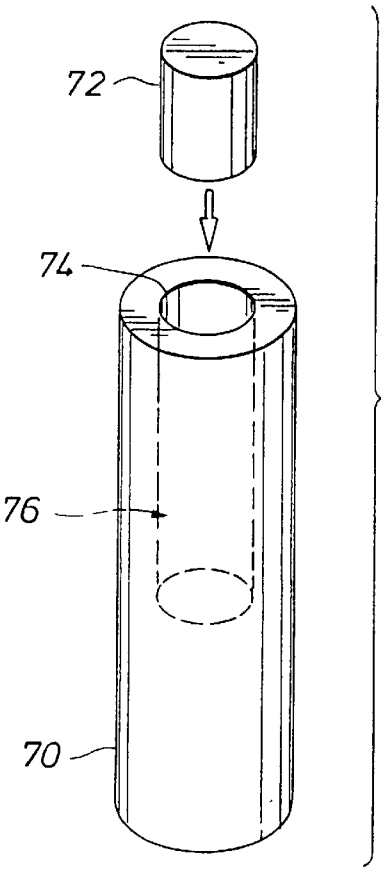
FIG. 4 shows a mold or cavity in a tube.

Attention is directed to FIG. 4 of the drawings which shows a replacement for the hollow tube shown in FIG. 3, and more particularly, a tube like construction is preferred to enable the tube to travel in linear fashion through central area 20 of the microwave cavity as previously discussed. It is mounted in the same equipment as shown in FIG. 1, and is preferably advanced in a linear fashion. Rotation again is imparted by the motor 16. This distributes microwave heating more uniformly through the molded part which is helpful but not required. The valve 36 is not used in this application. FIG. 4, therefore, illustrates a simple mold cavity in an elongate ceramic rod which can be divided into two parts so that it can be filled, thereby obtaining a cast or molded part. The shape of the finished part will be the same shape as the cavity.

The mold in FIG. 4 shows a simple mold which can be used for casting a tooth or wear insert for drill bits. The finished product is an elongate cylindrical body as illustrated as the tooth 110 in FIG. 2. A solid ceramic tube 70 contains an axial passage 74. A plug 72 has a diameter to fit snugly in the axial passage 74. There is a cavity region at 76 shown in dotted line in FIG. 4. That region is the cavity in which the cast tooth or insert is made. Particulate material for the cast or molded tooth is put into the cavity 76 in the geometry required for the finished product. The plug 72 is fitted in the passage 74. Pressure is applied to pack down the material. While pressure is applied, the pressure that is necessary for this degree of packing is at least several orders of magnitude less than the pressures that are presently sustained in the manufacturing of such extra hard wear parts. The conventional HPHT manufacturing technique requires a hydraulic press with pressures of up to one million pounds per square inch (psi). In this instance, the pressure need only be sufficient to pack and force the material into a defined shape. The plug 72 is therefore pushed against the particulate material in the cavity 76. This defines the cast cylindrical part and the part when finished will have the shape of the cavity 76. For ease of extraction, it may be desirable to split the cylindrical body 70. In an alternative aspect, other shapes can be cast in the mold which may be formed of two or more pieces depending on the shape and complexity of the molded part. Furthermore, the material can be precast with a sacrificial material such as wax or other materials prior to insertion for microwave heating. If sufficiently self adhesive, the particles can be precast by simple compaction at low pressure. Precasts are supported in the central area 20 for sintering by means of any convenient microwave transparent structure such as a net made of microwave transparent material. What is desired in this particular instance is that the conformed shape of the hard part is achieved by the mold, and that the cavity within the mold, as a preliminary step, be filled with the desired material.

To make such a wear part, the particulate material that is placed in the cavity is typically and conventionally a hard metal carbide, nitride or other particulate material having extreme hardness. Tungsten carbide (WC) is the most common of these material although others are also known. In addition to that, a matrix of a cobalt based alloy is added. The other alloy components depend on the specifics of the requirements. Typically, the alloy is about 80 to 96% cobalt. The preferred alloy material is mixed in particulate form with the hard particles. When sintered, the particulate alloy will melt and seep into all the crevices and pores among the particles in the cavity and thereby form a binding matrix. The finished product will then have particles of extreme hardness held together in the alloy matrix.

In one aspect of the finished product, the alloy holds the particles together and this is especially true for both metal and ceramic particles. The term "cermet" has been applied to a mixed combination of materials including those made of ceramics and metals. The present procedure can be used to make a metal insert or other wear piece, and is also successful in casting cermets. Whatever the case, the rod-like mold shown in FIG. 4 in inserted into the cavity in the fashion shown in FIG. 3. It is passed through the microwave central cavity area 20 in a linear fashion if necessary. Optionally, rotation is applied to more evenly distribute the microwave radiation for even sintering. This enables sintering in a manner which provides improved characteristics for the finished product. This is one of the benefits of microwave sintering.

IMPROVED GRAIN STRUCTURE

One aspect of the apparatus of the present disclosure is the modification of the grain structure of the finished product. After sintering, the grain structure is quite different from that obtained from conventional heating procedures. As a generalization, cast parts are formed by application of very high pressure and temperature for a long interval. As a generalization, the grain structure tends to grow. To stop this, inhibitors are added. A desirable grain structure in accordance with the teachings of the present disclosure however contemplates grains which are under 1.0 micron in size without growth inhibitors. Even smaller grain structures such as 0.1 micron dimensions can be utilized through the use of the present disclosure. The subject invention therefore provides a greater reduction in grain size and the micro structure as observed by various investigation instruments, such as a SEM, is enhanced by reduction of grain size without the use of the required inhibitors restraining growth.

Common growth inhibitors include vanadium or chromium, or compounds involving these. When added, they do limit grain growth during sintering, but they also have undesirable side effects. They alter the physical characteristics of the finished product. In some regards, another grain growth inhibitor is obtained by adding titanium carbide (TiC) or tantalum carbide (TaC). The addition of either of these two compounds causes undesirable side effects as evidenced by a change in physical characteristics.

Trace additions of vanadium or chromium are particularly detrimental where the cast or molded part is to be subsequently joined to a polycrystalline diamond compact. They are typically joined to a tungsten carbide insert body for use in drill bits. The PDC is adhered in the form of a cap or crown on the end of the tungsten carbide based body. The tungsten carbide insert body is joined by brazing or other heating processes to the PDC crown. In doing that, the heating process tends to draw vanadium and chromium into the region of the PDC bond. The vanadium and chromium additives which otherwise inhibit grain growth have a detrimental impact on the PDC crown which is later adhered to the insert body, i.e., by brazing or otherwise. It is therefore highly undesirable to incorporate such grain growth inhibitors.

Through the use of the present disclosure, a smaller grain can be achieved without addition of vanadium or chromium. This enables the fabrication of a substantially pure insert body (by that, meaning that it has no vanadium or chromium or other PDC poisons in it), thereby enabling an enhanced construction of a PDC crown insert body. The present disclosure therefore provides an insert body which can be subsequently joined to the PDC crown.

REDUCED COBALT DIFFUSION

Figure 5:
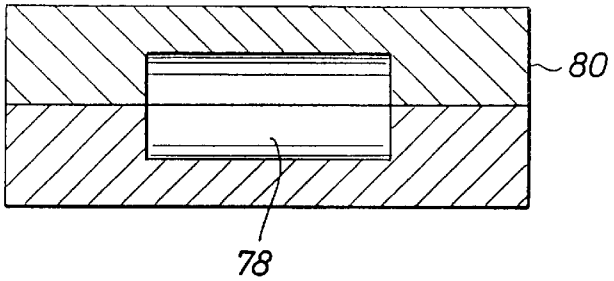
FIGS. 5 and 6 show views of a two-piece mold.
Figure 6:
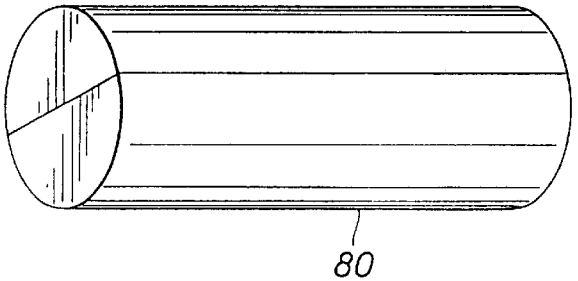

Attention is next directed to FIGS. 5 and 6 where a mold cavity 78 is shown in a two-piece mold 80. Conveniently, the mold 80 is in the form of the rod shown in FIG. 6. This enables the rod 80 to be advanced through the microwave chamber shown in FIG. 3 for sintering. As will be understood, the rod 80 can be of any length and therefore it can hold one or more such cavities. It is shown comprised of two mold pieces which divide and separate. This enables the cavity to be filled. It is filled with particles which can be loosely packed in the cavity. It is not necessary that the mold pieces divide precisely on the diameter of the rod 80. Therefore the cavity can be exposed for easy filling in this approach, or filling in the fashion shown in FIG. 4. It will be understood that there are many techniques for filling mold cavities with particulate material prior to microwave sintering to form the finished product. As an example, the particulate material can even be precast as discussed above and simply conveyed by the rod while being supported internally by microwave transparent structure. In any event, the rod 80 functions as a mold cavity and is constructed so that it progresses through the equipment shown in FIG. 3. This typically involved rotation of the rod 80 to distribute the microwave energy substantially evenly through the parts being made in the cavity. Again, the rod is also moved in a linear fashion through the equipment so that a specific dwell time in the microwave energy field is obtained. The rod 80 may have one or several cavities in it. If many, the rod is moved in the illustrated fashion through the equipment so that all of the cavities are exposed for full sintering.

Figure 7:
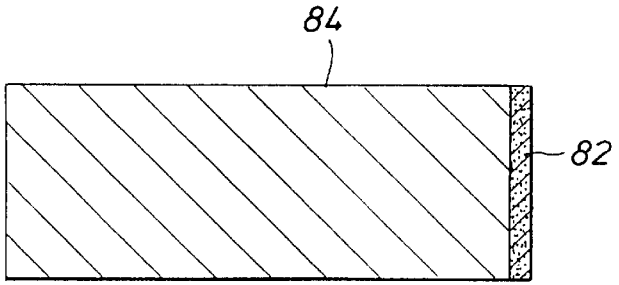
FIG. 7 is a sectional view through a sintered wear part having an extra-hard PDC layer at one end and a WC body.

Going now to FIG. 7 of the drawings, a simple cylindrical composite tooth or insert is shown. In this particular instance, it is provided with a PDC layer 82 adjacent to a WC body 84. The PDC layer is formed of small industrial grade bits of diamonds which are mixed with a binder. The binder is a cobalt based alloy and is mostly cobalt. The WC body is likewise a sized or screened set of WC particles which are held together in a cobalt alloy. The two components are each provided with different concentrations or amounts of cobalt in the alloy. The binding alloy itself is typically in the range of 80% to about 95% cobalt; there is however a difference in the amount of cobalt alloy material in the two regions. FIG. 7 shows the PDC layer 82 as a definitive covering which has a sharply defined interface. In the past, that has been an inherent weak area of manufacture of the components when formed by separate procedures where they are then joined by brazing. This definitive braze interface has been the source of problems. On the one hand, it is common to have such a sharply defined structural interface characterized in that cobalt concentrations can be quite different on the two sides of the interface. The interface region has been detrimental on the other hand in that the joinder of the two materials creates stresses which remain after cooling. Even worse, the two regions (PDC and carbide body) have different thermal expansion rates. That sometimes creates even greater internal stresses dependent on the ambient temperature of the device. Suffice it to say, this sharply defined interface of the past was a direct result of manufacture of the PDC layer 82 separate and remote from the WC body 84 and thereafter joining the two at the sharply defined interface. By using the approach taught herein, the particles for the diamond layer 82 are placed in the mold, and the particles for the WC body are also placed in the mold. The interface is not as sharply defined and is irregular (to the extent the particles compact together) in that the particles are irregular in shape and packing. Conveniently, the particles can initially be held together with a volatile wax which is driven off by heating. This serves as a simple sacrificial binder which is completely ejected from the mold cavity during heating. Indeed, the mold pieces need not join so tightly that they define an air tight chamber. Thus the binding wax can be readily applied to the loose particles to hold them ever so slightly prior to placing the particles in the cavity. With or without a binding wax, the particles are placed in the mold cavity and are subsequently sintered. The finished product is shown in FIG. 7 and comprises the PDC layer 82 which is sintered simultaneously with the WC body 84 so that the two are joined together. The bond between the two is sufficient to hold the PDC crown on the insert body so that it does not readily break or separate. Stress concentration at the interface is markedly reduced. Also they may be reduced further by undulating the interface.

Again, the PDC crown 82 is best joined directly to the WC body 84. However, the body can have a braze layer in the assembled insert between the layers. Through the microwave sintering process, the particles in the unconsolidated state are sintered quickly, not over the long lime interval otherwise involved in conventional sintering. Shorter time intervals are possible because of the partially absorptive nature of the materials used in the microwave sintering process. This shorter sintering time preserves the differences of the cobalt bonding material in the different regions.

Reduced Sintering Temperature

As discussed previously, the sintering temperature can adversely affect the physical and chemical properties of the sintered material, and this is particularly true of the wear layer such as the PDC layer. Excessive sintering temperature can perturb the crystalline structure of the carbon, and can enhance oxidation of carbon if oxygen is present. The techniques of the present invention significantly reduce the maximum sintering temperature required as well as the sintering time interval, as has been discussed and illustrated in previous sections. Using the methodology taught by the present disclosure thereby significantly reduces sintering temperature damage to articles of manufacture.

Low Temperature-Low Pressure Alloys

The low temperature-low pressure alloys disclosed in the previously referenced Application can effectively be used in the present invention. As an example, a mix of diamond powders having grain sizes of approximately 100 to 25 microns is placed in a thin refractory metal cup. A metal binding phase containing mostly zirconium powder with some trace additions of other metals to enhance the properties of the binding phase is placed in the cup. The ratio of diamond to metal powders is approximately 60:40 percent by volume. After microwave heating to a temperature of about 1,100° C., the cup yields the cast insert. The material can alternately be precast thereby eliminating the need for the mold cup. As an additional example, a mix of diamond powders having grain sizes of approximately 400, 100, and 25 microns is placed in a mold. A metal binding phase consisting of approximately 70% titanium, 15% copper, and 15% of material in the form of metal powders is also placed in the same container. This assembly is then microwave heated to about 1,000° C. over the course of about 40 seconds in a reducing atmosphere of nitrogen and hydrogen. The assembly is then allowed to cool in air to room temperature. When the mold is removed from the assembly, the abrasion resistant material described in this disclosure will then be bonded to the substrate as previously described. Once again, the insert can alternately be precast thereby eliminating the need for the mold.

Cobalt diffusion is especially a problem in a typical two component system in which notable differences exist between the cobalt concentrations. Consider as an example that the granular components of a PDC are inserted in the bottom of a mold. For instance, they can be held together with compacting pressure which is only a few psi. Alternately, they can be held together with a sacrificial wax. Primarily, the components are irregular diamond pieces, i.e., pure carbon. The binding matrix is an alloy added in small amounts. While other alloy metal portions are found in the matrix, the key ingredients in the PDC are the diamonds (meaning pure carbon). The body of the insert is formed of tungsten carbide particles. Again, even should other hard materials be used such as various nitrides, the problem remains substantially the same. Accordingly, the WC particles are mixed with a supportive matrix again formed of cobalt and other trace metals. This is compacted in the mold, and again can be either precast or confined in a mold either under compacting pressure or with a sacrificial wax or both. The problem that particularly plagues this type of manufacturer is diffusion of the cobalt. Assume to make an example that the cobalt amounts to about 13% of the WC insert body. When sintered in the manner used heretofore, the two components (the crown separate from the insert body) had to be made separately. If sintered together, cobalt diffusion would leach some of the cobalt from the layer having the most and diffuse it into the other layer. The net result would be that both regions (PDC and body) would have a different amount of cobalt than intended and would change their structural characteristics accordingly. One way of coping with this was to simply to make the two separate. When made separately however difficulties would arise from the stress concentration at the interface. One cure is separate manufacture and brazing with a thicker braze layer. This changes the internal stresses somewhat by forming a more soft and malleable interface between the two more brittle layers. That however had its own difficulties. Simultaneous sintering of the two components was typically not available because cobalt diffusion would occur over the long time intervals required to join the two sintered components (crown and body).

The present approach can readily manufacture a two component drill bit insert in a manner in which they are sintered together and even simultaneously yet without bleeding so that the cobalt concentrations can be different before sintering and cobalt differences are preserved. By microwave sintering in accordance with the teachings of this disclosure, the high concentration region of cobalt in the finished product maintains its high concentration. The adjacent regions (with lower initial cobalt concentrations) maintain the desired cobalt concentration. Using an example, assume that the PDC crown is made with about 0% cobalt, while the WC insert body is preferably fabricated with 6% cobalt concentration, or at least with a difference of 5% or greater. Through microwave sintering, that difference of 5% or more is preserved. The unsintered components are compacted into a mold or else precast and then sintered. This approach enables the finished product to preserve cobalt differences, even as great as 5% or more. Moreover, the interface between the two regions has reduced residual stresses after manufacture has been finished. Even though there may well be a different thermal coefficient of expansion for the two regions, there is a better bond between the two regions, i.e., fracture at the interface is less likely to occur. Accordingly, one benefit of the present process is to provide a unicast insert, i.e., one in which all the components are sintered simultaneously. The unicast insert is provided with the desired levels of cobalt concentration at the two regions. Yet, it is made in a single processing step so that handling and manufacturing is less costly. Moreover, performance appears quite desirable. Briefly, one preferred form of the present apparatus is formed by using the mold shown in FIG. 4 to place diamond particles at the bottom, the particles being sized in the range of perhaps 25 microns up to perhaps 400 microns. They are pressed in the chamber. They make up about 94% to 98% of that layer. Typically, trace amounts of metal may be added to the extent of 2% to about 5%. It is not necessary to add cobalt in this layer. This will enable the diamonds to adhere into a sintered mass defining the PDC layer. On top of that, the WC insert body is then placed. It typically will have at least 5% or more cobalt than the PDC layer and typically will be in the range of only about 6% to about 10%. Historically, cobalt quantities used have been in the range of about 13% to about 16%, and have clustered primarily around 15%. Different characteristics in performance are obtained by making the insert body with less cobalt but more than 5% greater than the PDC layer. Accordingly, one important version of the present apparatus is an insert having a hard body, typically formed of an alloy binding tungsten carbide particles together. The preferred form is WC although other hard carbides and nitrides can be used it preferably has a metal alloy mixed in it which has a concentration in the range of about 6% cobalt (the cobalt is about three-fourths or more of the binding alloy). The binding alloy is in the range of about 6% and can be as much as about 10%, but that is the upper end of the range and it is preferable to be toward the lower end of about 6% or perhaps 7%. The body of the insert can be made separately (meaning sintered separately and later bonded to the PDC) or they can be made jointly in a common mold at the same time, i.e., by placing particles of the two separate portions in the same cavity and sintering them together either in the application of micro-wave energy or in the HPHT process used heretofore.

In one particular aspect, the present invention provides a different two component (meaning PDC crown and hard body) molded construction with an interface between the two regions (the interface at the PDC/WC body).

In the following claims, it should be understood that the term polycrystalline diamond, PDC, or sintered diamond, as the material is often referred to in the literature, can also be any of the superhard abrasive materials, including, but not limited to synthetic or natural diamond, cubic boron nitride, and wurtzite boron nitride as well as combinations thereof. Also, cemented metal carbide refers to a carbide of one of the group IVB, VB, or VIB metals which is pressed and sintered in the presence of a binder of cobalt, nickel, or iron and the alloys thereof.

This disclosure is related to composite or adherent multimaterial bodies of diamond, cubic boron nitride (CBN) or wurtzite boron nitride (WBN) or mixtures thereof for use as a shaping, extruding, cutting, abrading or abrasion resistant material and particularly as a cutting element for rock drilling.

While the foregoing is directed to the preferred embodiment, the scope thereof is determined by the claims which follow.

What is claimed is:

1. A method for making a wear resistant element comprising the steps of:

(a) providing particulate material comprising
  (i) abrasion resistant particles, and
  (ii) an alloy binding material; and (b) sintering said material to a PDC layer using microwave radiation as a heat source thereby forming said wear resistant element.

2. The method of claim 1 comprising the additional steps of:

(a) providing the PDC layer which is formed by sintering a second mix of particulate materials; and (b) joining said wear resistant element to said PDC layer using microwave radiation as a source of heat thereby forming a composite wear resistant element.

3. The method of claim 1 wherein said abrasion resistant particles are formed by:

(a) providing abrasion resistant material which is at least partially absorptive of microwave radiation;

(b) exposing said abrasion resistant material to microwave radiation; and (c) sintering said abrasion resistant material using heat resulting from the absorption of said microwave energy.

4. The method of claim 1 for making a wear resistant element further comprising the steps of forming said particulate material in a desired shape for said wear resistant element by sintering said particulate material with a cobalt based alloy by heat generated within said particulate material by the absorption of said microwave radiation.

5. The method of claim 4 wherein said particulate material is exposed to said microwave radiation within a microwave chamber.

6. The method of claim 5 wherein said particulate material is formed into said desired shape by a mold.

7. The method of claim 6 wherein said mold is transparent to said microwave radiation.

8. The method of claim 6 wherein said mold is conveyed within said microwave chamber so that said particulate material within said mold is uniformly heated.

9. The method of claim 5 wherein said particulate material is formed into said desired shape by precasting prior to exposure to said microwave radiation thereby forming a precast element.

10. The method of claim 9 wherein said particulate material is bonded to form said wear element precast by means of a sacrificial compound.

11. The method of claim 9 wherein said precast is conveyed within said microwave chamber such that said particulate material within said precast is uniformly heated.

12. The method of claim 4 wherein said particulate material comprises the ingredients of a low temperature alloy and wherein binding material comprises:

(a) bonding material which wets and reacts with said abrasion resistant particles; and (b) particulate material in said cobalt based alloy in which said particulate materials are suspended and bonded.

13. The method of claim 12 wherein said cobalt alloy consists primarily of cobalt.

14. The method of claim 12 wherein said cobalt supports abrasion resistant particles which consist essentially of diamond, cubic boron nitride, or polycrystalline agglomerates.

15. A method for sintering a drill bit insert having two parts with different cobalt concentrations therein and comprising the steps of:

(a) providing microwave radiation;

(b) exposing said insert to microwave radiation;

(c) elevating the temperature of said structure to a sintering temperature as a result of absorption of said microwave radiation by said structure; and (d) ending the sintering prior to cobalt migration between the two parts.

16. The method of claim 15 wherein said insert comprises a PDC crown and including the initial step of forming the crown with a particulate crown layer featuring hard particles, and forming the second part with a cobalt concentration of at least about 5% cobalt difference from said crown.

17. The method of claim 15 wherein said drill bit insert has a first part formed of hard metal carbide particles and cobalt alloy is mixed therewith; and said second part is diamond particles, and said cobalt alloy concentration prior to sintering differs between said parts.

18. The method of claim 17 wherein said cobalt alloy concentration is between about 6% and 10% in said first part.

19. The method of claim 17 wherein said cobalt alloy concentration is above 0% in said second part.

20. The method of claim 1 for making a drill bit insert comprising the steps of:

(a) providing the particulate material for a sintered insert body comprising (i) said abrasion resistant particles, and (ii) said cobalt alloy binding alloy; and (b) sintering said insert body to the PDC layer to form said drill bit insert.

21. The method of claim 20 comprising the additional steps of:

(a) forming the PDC layer by sintering a mix of particulate diamonds; and (b) joining said insert body to said PDC layer using microwave radiation as a source of heat thereby forming a composite wear resistant element.

22. The method of claim 20 for making a drill bit insert further comprising the steps of forming said insert body by sintering said particulate material with a cobalt in the range of about 6% to 10% and wherein said PDC layer has essentially no cobalt.

23. The method of claim 22 wherein said drill bit insert is formed into the desired shape by molding particles to the desired shape.

24. The method of claim 23 wherein said drill bit insert is precast by a sacrificial compound.

25. The method of claim 20 for sintering a drill bit insert having different cobalt concentrations therein and comprising the steps of:

(a) providing a heating source;

(b) exposing said insert to said heating source;

(c) elevating the temperature of said insert to a sintering temperature; and (d) ending the sintering prior to cobalt migration between the two parts.

26. The method of claim 25 wherein said finished insert comprises a PDC crown and including the initial step of forming the crown with a particulate crown layer and essentially no cobalt, and forming the insert body with a cobalt concentration of at least about 5% greater cobalt than said crown.

27. The method of claim 25 wherein said cobalt alloy concentration is between about 6% and 10% in said insert body.

28. A method of forming a shaped wear part comprising the steps of:

(a) forming a compacted metal body of particles pressed to a desired shape wherein the body is formed of steel particles;

(b) forming a wear resistant area on the metal body comprised of (i) abrasion resistant particles;

(ii) an alloy of binding particulate material;

(c) microwave sintering said formed materials to form a unitary body.

29. The method of claim 28 including the step of forming a unitary PDC layer on the wear resistant area during sintering.

* * * * *

UNITED STATES PATENT AND TRADEMARK OFFICE
Certificate

Patent No. 6,063,333 Patented: May 16, 2000

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of the patent is: Mahlon D. Dennis, Kingwood, TX; Dinesh Agrawal, State College, PA; Roy Rustum, State College, PA; Jiping Cheng, State College, PA; Paul Gigl, State College, PA.

Signed and Sealed this Sixth Day of March, 2001.

ROY V. KING
*Superviosry Patent Examiner*
Art Unit 1742